US011324102B2

(12) United States Patent
Kim et al.

(10) Patent No.: US 11,324,102 B2
(45) Date of Patent: May 3, 2022

(54) APPARATUS FOR EXTRACTING MULTIPLE LASER COMPTON SCATTERING PHOTON BEAMS

(71) Applicant: KOREA HYDRO & NUCLEAR POWER CO., LTD., Gyeongsangbuk-do (KR)

(72) Inventors: Yonghee Kim, Daejeon (KR); Jiyoung Lee, Daejeon (KR); Seongdong Jang, Daejeon (KR); Ur Rehman Haseeb, Daejeon (KR); Eun Ki Lee, Daejeon (KR); Young Ae Kim, Daejeon (KR); Ji Eun Jung, Daejeon (KR)

(73) Assignee: Korea Hydro & Nuclear Power Co., Ltd., Gyeongsangbuk-do (KR)

( * ) Notice: Subject to any disclaimer, the term of this patent is extended or adjusted under 35 U.S.C. 154(b) by 89 days.

(21) Appl. No.: 16/647,700

(22) PCT Filed: Sep. 18, 2017

(86) PCT No.: PCT/KR2017/010191
§ 371 (c)(1),
(2) Date: Mar. 16, 2020

(87) PCT Pub. No.: WO2019/054540
PCT Pub. Date: Mar. 21, 2019

(65) Prior Publication Data

US 2020/0236767 A1 Jul. 23, 2020

(30) Foreign Application Priority Data

Sep. 18, 2017 (KR) ..... 10-2017-0119252

(51) Int. Cl.
*H05G 2/00* (2006.01)
*G21K 1/10* (2006.01)
*G21K 5/04* (2006.01)

(52) U.S. Cl.
CPC ..... *H05G 2/00* (2013.01); *G21K 1/10* (2013.01); *G21K 5/04* (2013.01)

(58) Field of Classification Search
CPC ..... H05G 2/00; H05G 2/008
(Continued)

(56) References Cited

U.S. PATENT DOCUMENTS 5,247,562 A * 9/1993 Steinbach ..... H05G 2/00 372/22
5,274,689 A * 12/1993 Palathingal ..... A61N 5/10 378/119

(Continued)

FOREIGN PATENT DOCUMENTS

JP 2012032220 A 2/2012

OTHER PUBLICATIONS

Heishun Zen et al., Generation of High Energy Gamma-ray by Laser Compton Scattering of 1.94-μm Fiber Laser in UVSOR-III Electron Storage Ring, Energy Procedia 89 (2016), p. 335-345. (Year: 2016).*

(Continued)

*Primary Examiner* — Allen C. Ho
(74) *Attorney, Agent, or Firm* — Standley Law Group LLP; James L. Kwak; Stephen L. Grant

(57) ABSTRACT

Disclosed is an apparatus for extracting multiple laser Compton scattering ("LCS") photon beams using a laser Compton scattering reaction, the apparatus including: a linear accelerator for accelerating an electron beam; and an LCS gamma ray generation module including an LCS gamma ray generator for irradiating a target with an LCS gamma ray generated by emitting laser light to an electron beam released from the linear accelerator and a bending magnet for adjusting a direction of the electron beam passed through the LCS gamma ray generator, wherein at least two (Continued)

LCS gamma ray generation modules are sequentially arranged to form a closed loop together with the linear accelerator.

6 Claims, 3 Drawing Sheets

(58) Field of Classification Search
USPC ..... 378/64, 119
See application file for complete search history.

(56) References Cited

U.S. PATENT DOCUMENTS 5,495,515 A * 2/1996 Imasaki ..... H05G 2/00 378/119
5,815,517 A * 9/1998 Ikegami ..... H01S 4/00 372/2
5,887,008 A * 3/1999 Ikegami ..... H05H 7/06 372/5
6,459,766 B1 10/2002 Srinivasan-Rao
7,277,526 B2 * 10/2007 Rifkin ..... G02B 5/10 378/119
8,138,678 B2 * 3/2012 Ishida ..... H05H 15/00 315/111.61
8,804,911 B2 8/2014 Toyokawa et al.
9,706,631 B2 * 7/2017 Barty ..... H05G 2/00
9,769,913 B2 * 9/2017 Urakawa ..... H01S 3/1109
9,983,151 B2 * 5/2018 Barty ..... A61B 6/481
2005/0226383 A1 10/2005 Rifkin et al.
2010/0080356 A1 4/2010 Ishida et al.
2012/0002783 A1 1/2012 Toyokawa et al.

OTHER PUBLICATIONS

Ryoichi Hajima, Linac-Based Laser Compton Scattering X-ray and γ-ray Sources, XXVI Linear Accelerator Conference, Sep. 12, 2012. (Year: 2012).*
Shuji Miyamoto et al., Laser Compton back-scattering gamma-ray beamline on NewSUBARU, Radiation Measurements 41 (2007), p. S179-S185. (Year: 2007).*
Rehman, H. et al., Optimization of Laser Compton Scattering for Transmutation of Long-living Fission Products, The 5th International Conference on Nuclear and Renewable Energy Resources (NURER2016), Sep. 18-21, 2016.

* cited by examiner

APPARATUS FOR EXTRACTING MULTIPLE LASER COMPTON SCATTERING PHOTON BEAMS

TECHNICAL FIELD

The present invention relates to an apparatus for extracting multiple laser Compton scattering photon beams using a laser Compton scattering reaction.

Statement Regarding Prior Disclosures by the Inventors

The invention has been published in NURER2016 on 18 Sep. 2016.

BACKGROUND ART

A laser Compton scattering (LCS) reaction is a reaction in which a low energy laser light is emitted to accelerated high energy electrons to cause inverse Compton scattering, thereby generating LCS photons of a specific energy region. The high energy LCS photons generated after the reaction may be used in various fields such as nuclear transmutation, physical experiments, and the like.

In particular, nuclear waste disposal corresponds to a backend of a nuclear fuel cycle and is a most challenging task. Radioactive waste contains various toxic and dangerous fissile materials. Many of these materials have short half-lives to quickly decay into stable nuclei, but some of the materials have very long half-lives. Such long-living fission products (LLFPs) are so mobile that special handling thereof is required. A common choice for inhibiting mobility of the LLFPs is disposal in geological repositories, but designing geological repositories that may store LLFPs for millions of years may not be a viable option. Meanwhile, another alternative may be a transmutation of the LLFPs into short-lived or stable nuclides.

Possible approaches for transmutation of toxic radionuclides are neutron capture reactions using (n, y) reaction. However, such a process has problems, namely, fairly large neutron flux ($10^{15}$-$10^{16}$ n/cm$^2$sec) is required and, according to transmutation from one nuclide to another, a neutron capture cross section is sharply changed. Another method is to use high-intensity gamma rays for photonuclear reactions using (y,n) transmutation. The (y,n) transmutation is governed by a giant dipole resonance (GDR) cross section. The GDR is a dominant excitation mechanism, in which a collective bulk oscillation of nuclei against all protons occurs. The GDR cross section is a function of a, slowly changing, mass number and does not sharply change according to transmutation from one radionuclide to another.

Such high intensity gamma rays for the excitation may be produced by other methods, and the most suitable method is using LCS technology.

An LCS phenomenon is that low energy (energy of approximately several eV) photons are scattered by an electron beam of the predetermined energy to produce very high energy gamma rays. FIG. 1 is a view conceptually illustrating the LCS phenomenon.

LCS gamma rays are quasi-monochromatic light with considerable energy and are energy-tunable. The gamma rays generated by such characteristics may overlap an energy range (10-20 MeV) of the GDR cross section of the LLFPs.

Of the various LLFPs, only a few are of major concern in terms of radioactive waste management, and when considering toxicity levels, half-life, effects on the repositories, and annual inventories as references, iodine and cesium have considerably significant problems in spent fuel handling. [Table 1] shows isotopic composition of radionuclides that require transmutation in spent nuclear fuel of a typical light water reactor (LWR).

TABLE 1

| Element | Isotope | Isotopic Composition (wt %) |
|---|---|---|
| Iodine | $^{127}$I | 22.98 |
| | $^{129}$I | 77.02 |
| Cesium | $^{133}$Cs | 76.41 |
| | $^{134}$Cs | 0.292 |
| | $^{135}$Cs | 16.83 |
| | $^{137}$Cs | 6.47 |

In general, because the GDR cross section does not show a significant change from one isotope to another, (y,n) reaction-based nuclear transmutation is required for isotope separation. Thus, some short-lived or stable isotopes may be transmuted into long-lived radionuclides with a considerable significant probability that the (y,n) reaction will proceed. [Table 2] shows a half-life of each of the radionuclides to be transmuted and of each of the products after (y,n) reaction.

TABLE 2

| Radionuclide | Product after (γ, n) reaction |
|---|---|
| $^{127}$I(stable) | $^{126}$I(12.93 d) |
| $^{129}$I($T_{1/2}$ = 15.7 × $10^6$ y) | $^{128}$I(24.99 m) |
| $^{133}$Cs(stable) | $^{132}$Cs(6.48 d) |
| $^{134}$Cs($T_{1/2}$ = 2.07 y) | $^{133}$Cs(stable) |
| $^{135}$Cs($T_{1/2}$ = 2.3 × $10^6$ y) | $^{134}$Cs($T_{1/2}$ = 2.07 y) |
| $^{137}$Cs($T_{1/2}$ = 30 y) | $^{136}$Cs($T_{1/2}$ = 13.16 d) |

When only the (y,n) reaction is considered from [Table 2], and iodine and cesium do not require any isotope separation. After being transmuted, each product becomes stable or short-lived, and some of the stable isotopes are transmuted also to radionuclides, which have very short-lived nuclides, thereby being able to be managed within the current waste management category.

Other considerations for this kind of transmutation may include higher order photonuclear reactions such as (y,2n), (y,3n), (y,xn), and the like, but threshold energy for higher order reactions other than (y,2n) reaction is very high. However, it was confirmed that the (y,2n) reaction has a considerably smaller cross section compared with the (y,n) reaction, and hence the (y,n) reaction may be maximized while minimizing (y,2n) reaction by optimizing the LCS spectrum.

DOCUMENTS OF RELATED ART

Patent Document

U.S. Patent Application Publication No. 2012-0002783 (published on Jan. 5, 2012)

DISCLOSURE

Technical Problem

Accordingly, the present invention has been made keeping in mind the above problems occurring in the prior art, and an object of the present invention is to provide an apparatus capable of extracting multiple LCS gamma rays to efficiently induce a nuclear transmutation by a photonuclear reaction to a target such as nuclear waste and the like.

Technical Solution

In order to accomplish the above objective, the present invention provides an apparatus for extracting multiple laser Compton scattering photon beams: the apparatus including: a linear accelerator for accelerating an electron beam; and an LCS gamma ray generation module including an LCS gamma ray generator for irradiating a target with an LCS gamma ray generated by emitting laser light to an electron beam released from the linear accelerator and a bending magnet for adjusting a direction of the electron beam passed through the LCS gamma ray generator, wherein the at least two LCS gamma ray generation modules are sequentially arranged to form a closed loop together with the linear accelerator.

The at least two LCS gamma ray generation modules may be arranged to irradiate a same target with the LCS gamma rays.

The LCS gamma ray generation modules may generate the LCS gamma rays of different energy from each other, thereby allowing photonuclear reactions to occur for targets of nuclides different from each other.

Bending angle $\theta$ of the electron beam of the bending magnet may be $0<\theta\leq 90°$.

Advantageous Effects

As described above, an apparatus for extracting multiple laser Compton scattering photon beams according to the present invention includes a linear accelerator and a plurality of LCS gamma ray generation modules. Each of the LCS gamma ray generation modules generates an LCS gamma ray, generated by Compton scattering due to an electron and laser light emitted to the electron, and includes a bending magnet adjusting a direction of the electron beam by which the LCS gamma ray has been extracted. In addition, at least two LCS gamma ray generation modules are sequentially arranged to form a closed loop together with the linear accelerator. Accordingly, a probability of inducing a specific nuclear transmutation using one linear accelerator can be increased, or induction of nuclear transmutation for various nuclides can be collectively carried out.

BEST MODE

Specific structures or functional descriptions presented in the embodiments of the present invention are illustrated only for the purpose of describing the embodiments according to the concept of the present invention, and the embodiments according to the concept of the present invention may be implemented in various forms. In addition, the present invention should not be construed as limited to the embodiments described herein, but should be understood to include all modifications, equivalents, and substitutes included in the spirit and scope thereof.

Hereinafter, with reference to the accompanying drawings will be provided description in detail with respect to the present invention.

Figure 1:
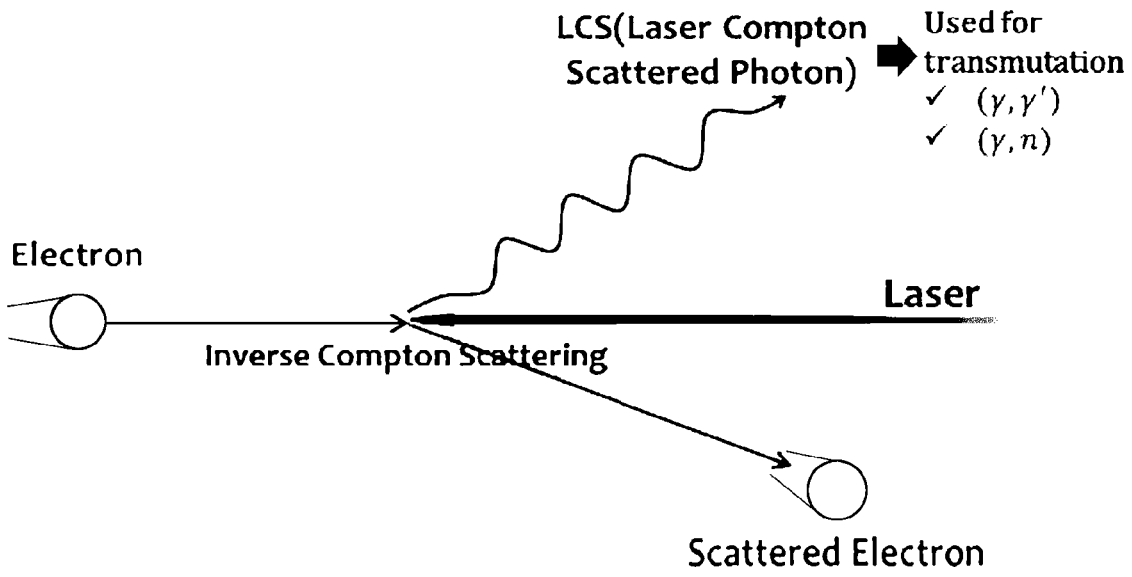
FIG. 1 is a view conceptually illustrating an LCS phenomenon.
Figure 2:
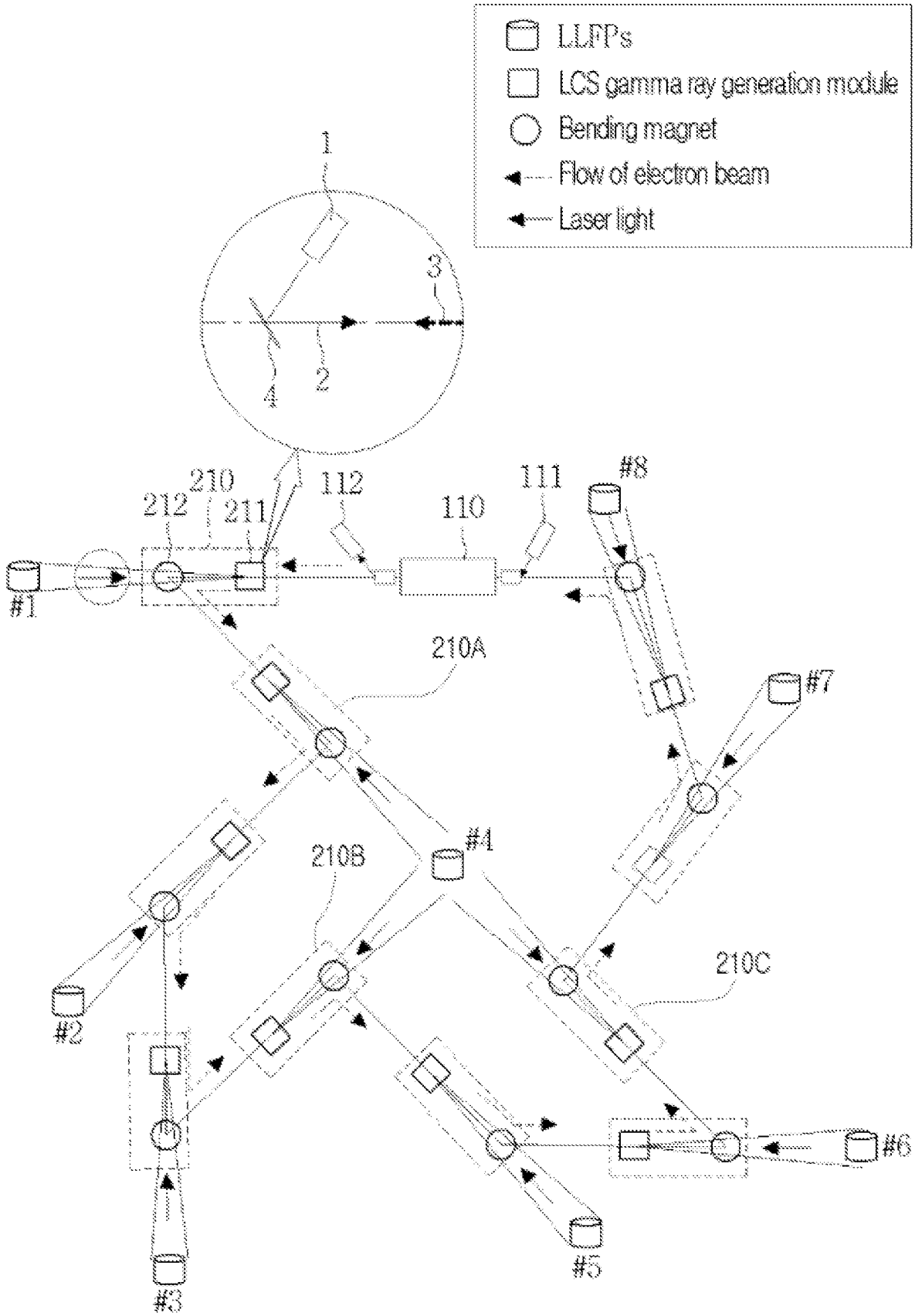
FIG. 2 is a diagram schematically illustrating an apparatus for extracting multiple laser Compton scattering photon beams according to an embodiment of the present invention.

With reference to FIG. 2, an apparatus for extracting multiple laser Compton scattering photon beams according to an embodiment of the present invention includes a linear accelerator 110 for accelerating an electron beam, and a plurality of LCS gamma ray generation modules 210 generate LCS gamma rays and to adjust a direction of the electron beam.

The linear accelerator 110 is for accelerating electrons and may be provided with an injector 111 at an inlet side for injecting electrons into a microwave cavity in which the electrons are accelerated or decelerated. In addition, the linear accelerator 110 may use as an energy recovery LINAC (ERL) constituting a closed loop with a plurality of the LCS gamma ray generation modules 210 and may be provided with a beam dump 112 capable of absorbing the electron beam by being installed at an outlet side thereof. Such a linear accelerator 110, in which acceleration of the electron beam is made, has a configuration the same as in the related art for the acceleration and focusing of the electron beam, and therefore description thereof will be omitted. In addition, a beamline having a vacuum state is provided between the linear accelerator 110 and each of the LCS gamma ray generation modules 210, thereby transporting the electron beam. At this time, it should be appreciated that equipment or instrumentation, which is a well-known supplementary installation used for a particle accelerator to focus or diagnose the electron beam, may be added in the beamline.

The LCS gamma ray generation module 210 includes an LCS gamma ray generator 211 irradiating a target with the LCS gamma ray generated by emitting laser light to an electron beam released from the linear accelerator 110 and a bending magnet 212 adjusting a direction of the electron beam passed through the LCS gamma ray generator 211.

The LCS gamma ray generator 211 may include a mirror 4 allowing the laser light 2 generated by a laser light source 1 to be emitted in the direction of the electron beam 3, wherein the mirror 4 may use a multilayer structure mirror that reflects only the laser light 2 of a predetermined wavelength band and is transparent to the LCS gamma rays. Such an LCS gamma ray generator 211 may be a separate chamber provided in the beamline in which the electron beam 3 is transported.

The LCS gamma ray generator 211 generates LCS gamma rays having a solid angle by elastic scattering between the accelerated electron beam 3 and the laser light 2, and nuclear waste, which is a long-living fission products (LLFPs), is irradiated with the LCS gamma rays, thereby causing a nuclear transmutation reaction to proceed.

The bending magnet 212 is for changing a path of the electron beam 3 and may be provided by an electromagnet or a superconducting magnet capable of generating a uniform magnetic field.

A plurality of the LCS gamma ray generation modules 210, each configured as described above, is configured such that at least two are sequentially arranged to form a closed loop together with the linear accelerator 110. In the present exemplary embodiment, eight units of nuclear waste, which is the LLFPs, and ten LCS gamma ray generation modules are illustrated, but the number and layout thereof may be variously modified.

Nuclear waste, which is the LLFPs, is irradiated with the LCS gamma rays generated in each of the LCS gamma ray generation modules 210 to cause a nuclear transmutation reaction to proceed, and one unit of nuclear waste, which is the LLFPs, may be arranged corresponding to one LCS gamma ray generation module 210 but is not limited hereto. For example, in the present embodiment, the fourth nuclear waste may be irradiated with the LCS gamma rays by three LCS gamma ray generation modules 210A, 210B, and 210C to increase the nuclear transmutation reaction efficiency.

Each of the LCS gamma ray generation modules 210 is emitted by the laser light 2 having different energy, thereby generating various LCS gamma rays using a single linear accelerator 110 as a whole. Here, the various LCS gamma rays may be determined depending on a nuclide of the nuclear waste, which is the LLFPs, to be disposed of.

The electron beam 3 generated by the linear accelerator 110 has a cycle of generating the LCS gamma rays, in the plurality of LCS gamma ray generation modules 210 sequentially arranged, and of entering into the electron accelerator 110 again. In addition, depending on a target (nuclear waste), the arrangement of the LCS gamma generation module 210 may be configured in various ways.

On the other hand, when taking a look at loss of the electron beam 3 generated in each of the LCS gamma ray generation modules 210, theoretically, a collision probability of the accelerated electron beam 3 and laser light 2 in the LCS reaction is only 0.0016%, so 99.9984% of the electrons in each LCS gamma ray generation module do not respond to the laser light 2. In addition, scattered electrons also maintain 99.1% of energy thereof compared to before being scattered. Therefore, the electron beam 3 passed through the LCS gamma ray generation module 210 has sufficient energy to cause an additional LCS reaction in a LCS gamma ray generation module of a next stage.

In addition, an energy loss ΔE of the electron beam 3, the energy loss being able to be generated in the bending magnet 212 of the LCS gamma ray generation module 210, may be calculated using [Equation 1] below.

$$\frac{X^E}{X^t}(\mathrm{GeV/s}) = \frac{c(\mathrm{m/s})C_\gamma(\mathrm{m/GeV^3})}{2\pi}\frac{E^4(\mathrm{GeV^4})}{\rho^2(\mathrm{m^2})} \quad \text{[Equation 1]}$$

Here, E is the energy of the electron beam 3, c is a speed of light, and $C_\gamma$ is a constant. Meanwhile, ρ is a bending radius and is represented by following [Equation 2].

$$\rho(\mathrm{m}) = \frac{lengthofmagnet(\mathrm{m})}{Bendingangle(\mathrm{rad})}\frac{l}{\theta} \quad \text{[Equation 2]}$$

From [Equation 1] and [Equation 2], it may be seen that the larger the bending angle in the bending magnet 212, the greater the energy loss. Therefore, in order to reduce the energy loss, the bending angle may be configured to be small. For example, the energy loss that may be generated when the bending angle is a right angle (90°) is no greater than 0.4%. Accordingly, the bending angle θ of the electron beam 3 of the bending magnet 212 may be determined between $0<\theta\leq 90°$.

Figure 3:
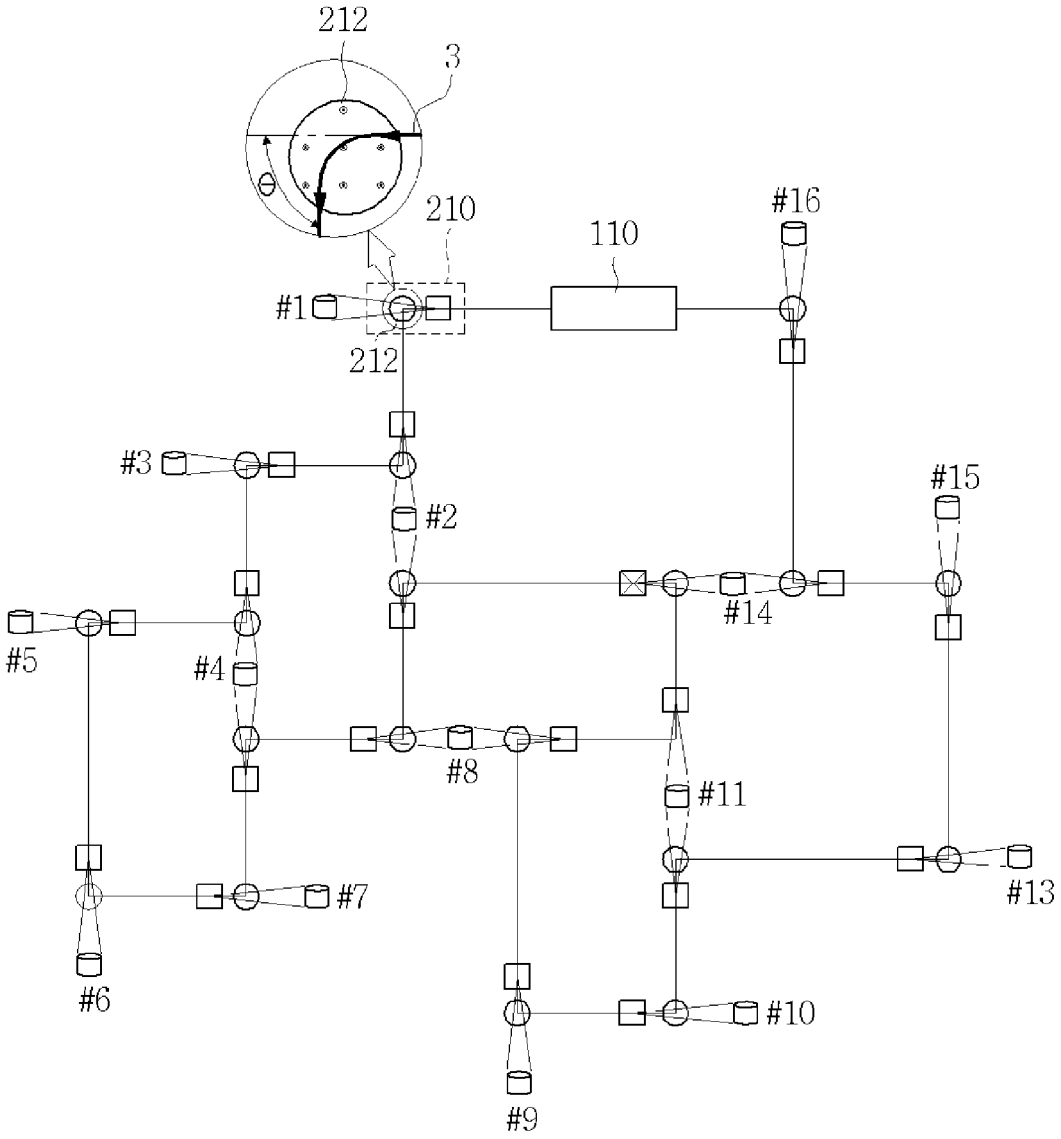
FIG. 3 is a diagram schematically illustrating an apparatus for extracting multiple laser Compton scattering photon beams according to another embodiment of the present invention.

FIG. 3 is a diagram schematically illustrating an apparatus for extracting multiple laser Compton scattering photon beams according to another embodiment of the present invention, wherein the bending magnet 212 of each of the LCS gamma ray generation modules 210 has a bending angle θ of the electron beam 3 of a right angle (90°). In the present embodiment, it is shown that five units of nuclear waste (#2, #4, #8, #11, and #14) are irradiated with the LCS gamma ray by two gamma ray generation modules.

As described above, the present invention may minimize the energy loss of the electron beam 3 by determining the bending angle of the electron beam 3 in the bending magnet 212 of each of the LCS gamma ray generation modules. In addition, by appropriately configuring the LCS gamma ray generation modules according to the number or nuclide of the target, it may increase a probability of inducing a specific nuclear transmutation using one linear accelerator or may collectively carry out induction of nuclear transmutation for various nuclides.

The present invention described above is not limited to the above-described embodiments and the accompanying drawings. In addition, it will be apparent to those skilled in the art that various substitutions, modifications, and changes may be made without departing from the technical spirit of the present invention.

DESCRIPTION OF THE REFERENCE NUMERALS IN THE DRAWINGS

110 Linear accelerator
210 LCS gamma ray generation module
211 LCS gamma ray generator
212 Bending magnet

The invention claimed is:

1. An apparatus for extracting multiple laser Compton scattering ("LCS") photon beams, the apparatus comprising:
- a linear accelerator for accelerating an electron beam; and
- at least two LCS gamma ray generation modules, each LCS gamma ray generating module including:
  - an LCS gamma ray generator for irradiating a target with an LCS gamma ray generated by emitting a laser light to an electron beam released from the linear accelerator; and
  - a bending magnet for adjusting a direction of the electron beam passed through the LCS gamma ray generator,
  - wherein the at least two LCS gamma ray generation modules are sequentially arranged to form a closed loop together with the linear accelerator.

2. The apparatus of claim 1, wherein the at least two LCS gamma ray generation modules are arranged to irradiate the target in common with LCS gamma rays.

3. The apparatus of claim 1, wherein the at least two LCS gamma ray generation modules generate LCS gamma rays of different energy from each other, thereby allowing photonuclear reactions to occur for targets of nuclides different from each other.

4. The apparatus of claim 1, wherein the bending magnet bends the electron beam having a bending angle θ greater than 0° and less than or equal to 90°.

5. The apparatus of claim 1, wherein the LCS gamma ray generator comprises:
- a laser light source that emits a laser light; and
- a mirror that reflects the laser light in the direction of the electron beam.

6. The apparatus of claim 5, wherein the mirror comprises a multilayer structure mirror that reflects only the laser light of a predetermined wavelength band and that is transparent to LCS gamma rays.

* * * * *